United States Patent [19]

Cedar

[11] Patent Number: 4,787,623

[45] Date of Patent: Nov. 29, 1988

[54] AEROBIC EXERCISE DEVICE

[76] Inventor: Larry Cedar, P.O. Box 319, Van Nuys, Calif. 91408

[21] Appl. No.: 93,955

[22] Filed: Sep. 8, 1987

Related U.S. Application Data

[63] Continuation-in-part of Ser. No. 927,399, Nov. 6, 1986, Pat. No. 4,693,469.

[51] Int. Cl.[4] ..... A63B 5/22

[52] U.S. Cl. ..... 272/74; 272/117; 272/128

[58] Field of Search ..... 272/74, 128, 122, 117, 272/123, 75

[56] References Cited

U.S. PATENT DOCUMENTS

| | | | |
|---|---|---|---|
| 1,505,473 | 8/1924 | Klubnick | 272/74 |
| 2,475,656 | 7/1949 | Bidak | 272/117 X |
| 3,182,999 | 5/1965 | Updaw | 272/74 |
| 3,690,655 | 9/1972 | Chapman | 272/117 X |
| 3,904,198 | 9/1975 | Jones | 272/123 |
| 4,043,553 | 8/1977 | Suarez | 272/123 X |
| 4,092,799 | 6/1978 | Anderson | 272/117 X |
| 4,192,501 | 3/1980 | Peoples | 272/75 |
| 4,664,373 | 5/1987 | Hait | 272/124 X |

FOREIGN PATENT DOCUMENTS

| | | | |
|---|---|---|---|
| 1164490 | 3/1984 | Canada | 272/74 |

*Primary Examiner*—Richard J. Apley
*Assistant Examiner*—Franklin L. Gubernick
*Attorney, Agent, or Firm*—Milton S. Gerstein

[57] ABSTRACT

An aerobic exercise device for simulating jump-roping in which there is provided a handle element and a tubular element rotatably coupled to an end of the handle element by a stretchable rubber member, which rubber member passes entirely through the hollow interior of the tubular member. Upon rotation of the rubber member and tubular element together by the handle gripped by a person's hand, the weight of the tubular element causes the rubber member to stretch because of centrifugal force to provide cushioning or shock absorption. A weight element is also provided about the outer circumference of the tubular element, which weight element is adjustably positionable along the tubular element via an o-ring that is snugly received in an open end of the weight element, so that the torque created during the revolving of the tubular element may be varied.

9 Claims, 1 Drawing Sheet

FIG. 1
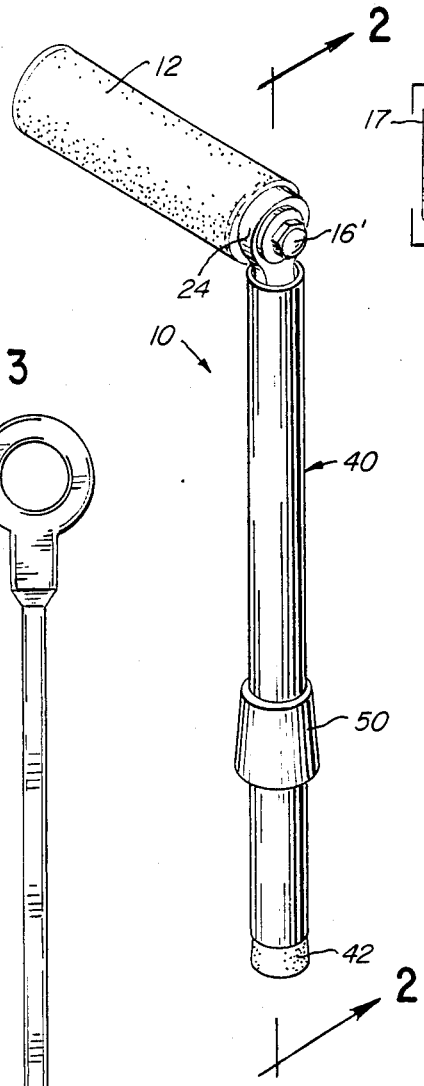
FIG. 2
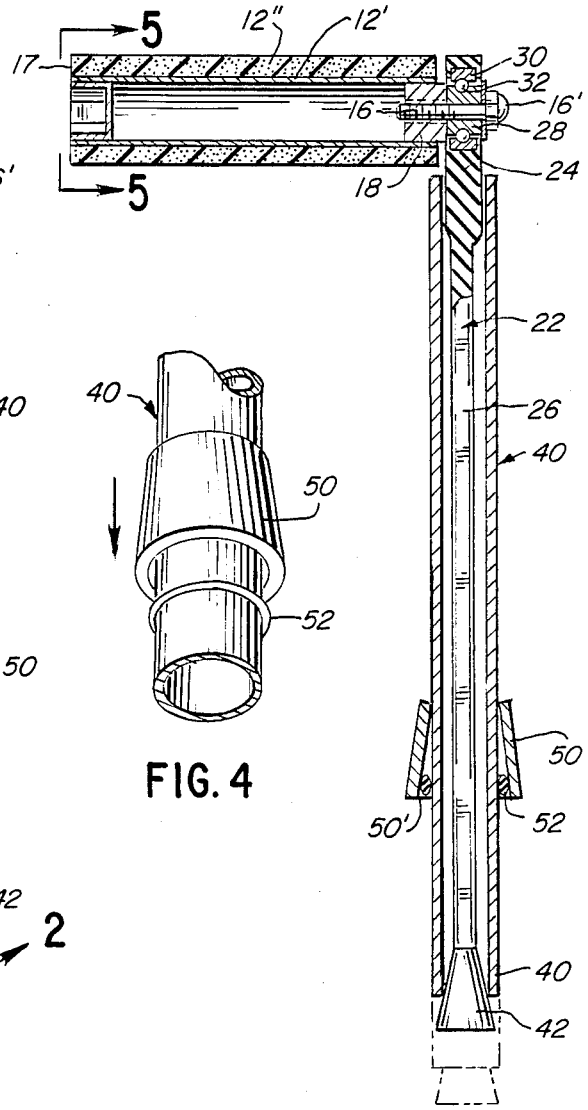
FIG. 3
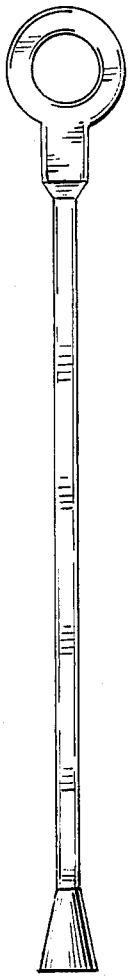
FIG. 4
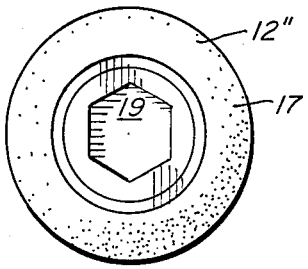
FIG. 5
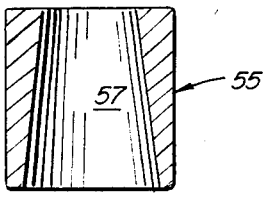
FIG. 6

AEROBIC EXERCISE DEVICE

CROSS-REFERENCE TO RELATED APPLICATION

The present application is a continuation-in-part application of applicant's copending U.S. application Ser. No. 927,399, filed on Nov. 6, 1986, and now U.S. Pat. No. 4,693,469, which is incorporated by reference herein.

BACKGROUND OF THE INVENTION

The invention is directed to a portable exercise device that allows for vigorous exercising by persons not able to afford expensive equipment or do not have the time to use facilities at a club or gym. Further, the invention is also directly suited to persons who find it difficult or undesirable to exercise o heavy cumbersome and complicated exercise equipment, such that the invention allows for relatively simple and uncomplicated exercising with substantially the same benefits accruing thereby as compared with these heavy and cumbersome prior-art apparatuses. In particularity, the present invention allows one to simulate jump-roping without the need of a jump rope, with all of the concomitant beneficial results, or to simulate only the arm movements of jump-roping alone without movement of the legs.

SUMMARY OF THE INVENTION

It is the primary objective of the present invention to provide an aerobic exercise device that is portable in nature, light-weight, and facile in use.

It is an objective of the invention to provide such a portable aerobic exercise device that allows one to exercise at the site of his choice, such as home, apartment, hotel room, and the like, without the need of setting up complicated or expensive equipment.

It is an objective of the invention tom provide such a portable aerobic exercise device that allows one to substantially simulate rope-jumping, for all of the benefical effects thereof, while avoiding tripping over any rope, or having to jump so high over the rope to clear it that knees are hurt.

It is yet another objective of the present to allow for use of the device of the invention in various ways so as to allow for the development and toning of various muscles.

It is a further objective of the invention to provide such an aerobic exercise device that is adjustable in the amount of torque it creates during exercising in order to be suitable to all types, ages and degree of skill of exercisers.

Toward these and other ends, the aerobic exercise device of the invention is substantially made up of a pair of separated and joined tubular elements, one element serving as a handle by which the device may be gripped by the hand, and the other tubular element serving as a weighted portion. The interconnection between the two elements is achieved via a flexible, stretchable, elongated connecting member extending through the hollow interior of the second tubular element that, firstly, allows for the rotation of the second, weighted tubular element about the handle element, and, secondly, allows for the second, weighted tubular element to extend radially outwardly by centrifugal force with respect to the first handle element by the stretching of the elongated connecting member, as the second, weighted tubular element is rotated about a center defined by the connection of the flexible connecting member with the first handle element, to provide shock-absorption, or cushioning, during the rotation of the weighted second tubular element. Further, the second weighted element is provided with a weight that is mounted for adjustable positioning about the outer circumference of the second tubular element, so that the moment, or torque, created by the weighted tubular element during its rotation is adjustable to fit the needs of the exerciser, so as to allow for greater control, for providing the best simulation to jump-roping as possible, and for preventing muscular damage and allowing for enhanced aerobic exercising. In the preferred embodiment, the end of the flexible connecting member rotatably coupled to nthe handle element is provided with an inner bearing that mounts that flexible connecting member for rotational movement about a fixed pivot shaft extending from the adjacent end of the handle element. The adjustably positionable weight, in the preferred embodiment, is a hollow, truncated-cone shaped element, the smaller diameter end of which has an inner diameter susbtantially equal to the outer diameter of the second weighted tubular element. The larger-diameter end of the weight receives therein an O-ring such that the O-ring is sandwiched between the inner surface of the weight and the outer surface of the weighted tubular element, so that the weight may be fixed in place along any desired outer circumferential portion of the second tubular element by simply moving the O-ring to the desired portion and force-fitting the O-ring into the larger-diameter end of the weight, to thereby frictionally retain the weight in place at that desired portion, the cone-shaped inner surface area of the weight providing the necessary wedging action to be achieved to create the correct amount of frictional engagement between the inner surface area of the weight and the O-ring.

BRIEF DESCRIPTION OF THE DRAWING

The invention will be more readily undserstood with reference to the accompanying drawing, wherein FIG. 1 is a perspective view of the aerobic exercise device according to the invention;

FIG. 2 is a cross-sectional view taken along line 2—2 of FIG. 1;

FIG. 3 is a side elevation view of the device of FIG. 1;

FIG. 4 is an enlarged detail view, in perspective, showing the cone-shaped weight-element and O-ring retainer therefor about the outer circumferential surface of the revolving tubular element;

FIG. 5 is an end view aling line 5—5 of FIG. 2;

FIG. 6 is a cross-sectional view of a modified weighted element.

DETAILED DESCRIPTION OF THE INVENTION

Referring now to the drawing in greater detail, the aerobic exercise device of the invention is indicated generally by reference numeral 10. The device 10 has a cylindrically-shaped handle element 12 having an inner hard core 12' and an outer concentric padded layer 12'' to provide comfortable and safe gripping by a hand. While the core 12' is shown as having a hollow interior, it may be solid. At one end of the core 12', there is provided a projecting pivot shaft 16 embodied by a screw threaded into a female opening formed in an interior block 18 mounted within the hollow interior of the core 12, as clearly shown in FIG. 1. When the core 12' is solid throughout, the need for the anchoring block 18 is obviated.

Rotatably coupled to the pivot shaft, and therefore to the handle element 12, is a flexible, stretchable elongated member 22 having an upper, or first, relatively thick portion 24 tapering into a lower, or second, narrow portion 26. The upper or first portion has a part thereof that is circular in shape, as shown in FIG. 3, and mounts an interiorly positioned bearing housing having an inner race 28, an outer race 30, and ball bearings 32. The pivot shaft 16 extends through the bearing housing, as shown in FIG. 1, to thereby anchor the inner race to the handle element 12. The outer race 30 is fixedly connected to the interior surface of the opening of the first portion of the elongated member 22, so that the elongated member is rotatable with respect inner race and the pivot shaft 16. The upper portion 24 of the elongated member 22 also provides for greater stability during rotation, so the elongated member 22 remains substantially in the same plane of rotation with no wobbling thereof. The elongated member 22 extends interiorly through a hollow cylindrical or tubular weighted element 40, as clearly shown in FIG. 2. At the end of the second portion 26 of the elongated member 22, there is provided an enlarged wedge-shaped member 42, which member 42 has diametric portions thereof greater than the inner diameter opening of the end 40' of the weighted element 40. The tubular element 40 is slidable relative to the elongated member 26, so that, upon rotation of the elongtated member 22 about the pivot shaft 16 via the handle element 12, the weighted tubular element 40 is forced outwardly away from the pivot shaft 16 by centrifugal force until the end 40' contacts the enlarged wedge-shaped member 42. At this stage, continued and increased angular velocity of revolving of the tubular element 40 causes the stretching and elongation of the elongated member 22 owing to the increased centrifugal forces associated therewith, to thereby create the shock-absorbing or cushioning effect above-identified. The wedge, or frustro-conical, shape of the member 42 also provides a gradual transition between stages defined by the angular velocities at which stretching or elongation of the member 22 is present. The stop member 42 may alternatively be a simple plug that is at all times fixedly connected in the open end 40' of the tubular element, whether the element 40 is revolving or not.

To allow for the adjustability of the moment or torque created during revolutions of the tubular element 40, there is provided a hollow, frustro-conically shaped weight element 50 defining a frustro-conically shaped interior volume surrounding the outer circumference of the tubular element 40, as seen in FIG. 2. The weight-element 50 is positionable at any portion along the outer circumference of the tubular element 40 via an o-ring 52 that frictionally engages the outer surface of the tubular element 40. In use, the o-ring is positioned at a desired portion of the outer circumferential surface, and thereafter the weight-element 50 is slid toward the o-ring until the o-ring is forced into the larger open end 50' of the weight-element, so that a tight frictional engagement is achieved therebetween. The o-ring is conventional and made of rubber, or the like, and may be moved along the tubular element 40 by rolling it, but not by sliding it. Therefore, upon the acceptance of the o-ring in the larger opening of the weight-element, the revolving of the tubular element will not cause the movement of the weight-element since the friction between the o-ring and the outer circumferential surface of the tubular element will prevent any relative movement. The position of the weight-element determines the torque developed during revolution at any given angular speed, with greater torque being created as the weight-element is positioned closer to the end 40'. The weight-element may take the form of a cylinder as shown in FIG. 6, with the weight-element 55 defining a frustro-conically shaped hollow interior 57. Depending upon the weight desired, the weight-element may be made of metal, plastic such as acrlyic, and the like.

The pivot shaft 16 is provided with a hexagonal-shaped head portion 16' by which the bolt constituting the pivot shaft may be rotated and removed or emplaced. This allows for a different combinataion of stretchable elongated member 22 and associated tubular element 40 to be easily and readily secured to the handle element 12, for replacement of parts, or for fast transition to greater torque-revolutions, where the replacing combination of member 22 and element 40 has a weighted element 50 of considerably greater weight than the combination being replaced. In order to rotate the bolt 16, the other end 17 of the handle element is provided with a hexagonally-shaped recess 19, as shown in FIG. 5, which snugly receives therein the head portion 16' of the bolt 16. Since two such devices 10 are used in order to exercise—one for each hand—the end 17 of other handle element 12 may be used to loosen and tighten the bolt 16 of the one device 10 for which a replacement combination is being provided.

In a modifiation of the device 10, instead of the use of an o-ring 50, the outer circumferential surface of the tubular element 40 is threaded, with the interior surface of the weight-element being cylindrical and also being matingly threaded, whereby the cylindrical weight-element may be relatively positioned along the element 40 by simply rotating it in one direction or the other.

While a specific embodiment of the invention has been shown and described, it is to be understood that numerous changes and modifications may be made therein without departing from the scope and spirit of the invention a set forth in the appended claims. The outer circumferential surface of the tubular element 40 is also preferably provided with lines or indicia to indicate the torque developed when the o-ring is positioned thereat, and serves as a convenient reference for repositioning the o-ring repeatedly at a specific portion of the tubular element.

What is claimed is:

1. An aerobic exercise device comprising:

a handle element having a first end and a second end;

a tubular element having a first end and a second end;

an elongated member having a first end rotatably mounted with respect to said handle element, and a second end, said elongated member being operatively coupled with said tubular element whereby said tubular element and said elongated member are rotatable together as a unit with respect to said handle element;

means operatively associated with said first end of said elongated member for rotatably mounting said first end to said handle element;

weight element means having a hollow interior for receiving therethrough a portion of said tubular element, said weight element means being positioned about the outer circumferential surface of said portion of said tubular element; and means for adjustably positioning said weight element means at a desired portion of said tubular element such that said weight element means is movable to any desired outer circumferential portion of said tubular element by the movement thereof along said outer circumferential surface and comprising a flexible o-ring means mounted about a portion of the outer circumferential surface of said tubular element and rollable along said outer circumferential surface of said tubular element;

said hollow interior of said weight-element means being substantially frustro-conical and being movable to any desired outer circumferential portion of said tubular element, said hollow interior of said weight-element means receiving therein said o-ring to frictionally retain said weight-element means at the desired location for the desired torque; said hollow interior of said weight-element means having a first larger diameter end opening and a second smaller diameter end opening, said o-ring being received in said first larger diameter end opening at any selected location of said weight element means.

2. An aerobic exercise device comprising:

a handle element having a first end and a second end;

a tubular element having a first end and a second end;

an elongated member having a first end rotatably mounted with respect to said handle element, and a second end, said elongated member being operatively coupled with said tubular element whereby said tubular element and said elongated member are rotatable together as a unit with respect to said handle element;

means operatively associated with said first end of said elongated member for rotatably mounting said first end to said handle element;

weight element means having a hollow interior for receiving therethrough a portion of said tubular element, said weight element means being positioned about the outer circumferential surface of said portion of said tubular element; and means for adjustably positioning said weight element means at a desired portion of said tubular element such that said weight element means is movable to any desired outer circumferential portion of said tubular element by the movement thereof along said outer circumferential surface;

said elongated member comprising a longitudinal axis and being stretchable and flexible, so that, upon rotation thereof about said handle element, centrifugal force causes the stretching thereof along said longitudinal axis; said first end of said elongated member being thicker and wider than the remainder of said elongated member in order to provide stiffness so that upon rotation of said elongated member, wobbling is substantially prevented and rotation thereof is constrained substantially in a plane of rotation perpendicular to the longitudinal axis of said handle element; said elongated member extending substantially through the hollow interior of said tubular element.

3. The device according to claim 2, wherein said elongated member further comprises an enlarged stop means at said second end thereof, said stop means being operatively associated with said second end of said tubular element, said stop means having at least a portion thereof of greater diametric expanse than the opening of said second end of said tubular element, whereby said second end of said tubular element is in contact against said stop means, whereby upon the revolving of said tubular element, centrifugal force causes said tubular element to stretch said elongated member via the abutment of said second end of said tubular element against said stop means.

4. The device according to claim 3, wherein said stop means is frustro-conical in shape to provide a wedge-type fit with the opening of said second end of said tubular element, said stop means partially projecting into the opening of said second end of said tubular element.

5. An aerobic exercise device comprising:

a handle element having a first end and a second end;

a tubular element having a first end and a second end;

an elongated member having a first end rotatably mounted with respect to said handle element, and a second end, said elongated member being operatively coupled with said tubular element whereby said tubular element and said elongated member are rotatable together as a unit with respect to said handle element;

means operatively associated with said first end of said elongated member for rotatably mounting said first end to said handle element;

weight element means having a hollow interior for receiving therethrough a portion of said tubular element, said weight element means being positioned about the outer circumferential surface of said portion of said tubular element; and means for adjustably positioning said weight element means at a desired portion of said tubular element such that said weight element means is movable to any desired outer circumferential portion of said tubular element by the movement thereof along said outer circumferential surface;

said means for rotatably mounting said first end comprising bearing means mounted in said first end of said elongated member, and pivot rod means having a first end fixedly connected to said second end of said handle element, and a second end, said pivot rod means at least partially extending through said bearing means, whereby said first end of said elongated member is rotatable about said pivot rod means via said bearing means.

6. The device according to claim 5, wherein said pivot rod means comprises a threaded shaft extending through said bearing means, said second end of said pivot rod means projecting outwardly from said bearing means; said second end of said pivot rod means having a multifaceted head portion for aiding in the turning thereof; said first end of said handle element comprising a multi-sided recess of the same general shape as said head portion for receiving said head portion therein, whereby said handle element may be used in the manner of a wrench in order to tighten and loosen the threaded shaft of the pivot rod means of another said aerobic exercise device.

7. The device according to claim 6, wherein said second end of said handle element comprises means for threadingly mounting said threaded shaft of said pivot rod means for allowing the tightening and loosening of said threaded shaft, whereby a different combination of elongated member and tubular element may be secured to said second end of said handle element, said different combination providing a different range of torques.

8. An aerobic exercise device comprising:

a handle element having a first end and a second end;

a tubular element having a first end and a second end;

an elongated member having a first end rotatably mounted with respect to said handle element, and a second end, said elongated member being operatively coupled with said tubular element whereby said tubular element and said elongated member are rotatable together as a unit with respect to said handle element;

means operatively associated with said first end of said elongated member for rotatably mounting said first end to said handle element;

weight element means having a hollow interior for receiving therethrough a portion of said tubular element, said weight element means being positioned about the outer circumferential surface of said portion of said tubular element; and means for adjustably positioning said weight element means at a desired portion of said tubular element such that said weight element means is movable to any desired outer circumferential portion of said tubular element by the movement thereof along said outer circumferential surface;

said elongated member being made of a rubber-like material, said tubular element being hollow, said elongated member projecting substantially through said hollow tubular element, said second end of said elongated member and said second end of said tubular element being in abutting cooperation, whereby upon rotation of said elongated member, said tubular element causes stretching of said elongated member by the mutual contact between said second ends thereof.

9. The device according to claim 8, said second end of said elongated member comprises an enlarged stop means having at least a portion thereof of greater expanse than the opening of said second end of said tubular element.

* * * * *